US010222043B1

(12) United States Patent
Pipitone

(10) Patent No.: US 10,222,043 B1
(45) Date of Patent: Mar. 5, 2019

(54) ILLUMINATED ORNAMENT ASSEMBLY

(71) Applicant: Jeffrey Pipitone, Waunakee, WI (US)

(72) Inventor: Jeffrey Pipitone, Waunakee, WI (US)

( * ) Notice: Subject to any disclaimer, the term of this patent is extended or adjusted under 35 U.S.C. 154(b) by 0 days.

(21) Appl. No.: 15/673,850

(22) Filed: Aug. 10, 2017

(51) Int. Cl.

| | |
|---|---|
| ***F21V 23/06*** | (2006.01) |
| ***F21V 17/10*** | (2006.01) |
| ***F21V 3/00*** | (2015.01) |
| ***F21V 23/00*** | (2015.01) |
| ***F21V 23/04*** | (2006.01) |

(52) U.S. Cl.
CPC ..... *F21V 23/06* (2013.01); *F21V 3/00* (2013.01); *F21V 17/107* (2013.01); *F21V 23/001* (2013.01); *F21V 23/04* (2013.01)

(58) Field of Classification Search
CPC . F21V 23/06; F21V 3/00; F21V 17/07; F21V 23/001; F21V 23/04
USPC ..... 362/253, 249.02, 121, 806, 807, 652, 362/653, 654, 249.16, 249.17; 439/131
See application file for complete search history.

(56) References Cited

U.S. PATENT DOCUMENTS

| | | | | |
|---|---|---|---|---|
| 3,873,880 | A | 3/1975 | Riddell | |
| 4,339,787 | A * | 7/1982 | Burnbaum | F21S 8/00 362/121 |
| D323,195 | S | 1/1992 | Gehibach | |
| D360,701 | S | 7/1995 | Glasstetter | |
| 5,451,842 | A * | 9/1995 | Chien | A47G 33/08 315/169.3 |
| 5,577,831 | A * | 11/1996 | Chang | F21V 33/0056 362/124 |
| 5,692,826 | A * | 12/1997 | Hsien-Jung | F21S 9/02 362/190 |
| 5,747,940 | A | 5/1998 | Openiano | |
| D407,038 | S | 3/1999 | Atilano | |
| 6,690,120 | B2 | 2/2004 | Oskorep et al. | |
| 7,175,302 | B2 | 2/2007 | Kazar et al. | |
| 7,287,991 | B1 * | 10/2007 | Li | H01R 35/04 439/131 |
| D572,624 | S | 7/2008 | Garrison | |
| 7,810,985 | B2 * | 10/2010 | Chien | F21S 8/035 362/641 |
| 7,963,663 | B2 | 6/2011 | Simard | |
| 2007/0081362 | A1 | 4/2007 | Lin | |

* cited by examiner

*Primary Examiner* — Laura Tso

(57) ABSTRACT

A illuminated ornament assembly for celebrating festive occasions includes housing that may be displayed for ornamental purposes. A light emitting array is positioned in the housing to emit light outwardly therefrom. The light emitting array emits light in a plurality of pre-determined patterns and colors. A connector is hingedly coupled to the housing. The connector is electrically coupled to the light emitting array and the connector is electrically coupled to a power source.

9 Claims, 9 Drawing Sheets

ILLUMINATED ORNAMENT ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

(e) STATEMENT REGARDING PRIOR DISCLOSURES BY THE INVENTOR OR JOINT INVENTOR

Not Applicable

(g) BACKGROUND OF THE INVENTION (1) Field of the Invention.

(2) Description of Related Art including information disclosed under 37 CFR 1.97 and 1.98.

The disclosure and prior art relates to ornament devices and more particularly pertains to a new ornament device for celebrating festive occasions.

(h) BRIEF SUMMARY OF THE INVENTION

An embodiment of the disclosure meets the needs presented above by generally comprising a housing that may be displayed for ornamental purposes. A light emitting array is positioned in the housing to emit light outwardly therefrom. The light emitting array emits light in a plurality of pre-determined patterns and colors. A connector is hingedly coupled to the housing. The connector is electrically coupled to the light emitting array and the connector is electrically coupled to a power source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
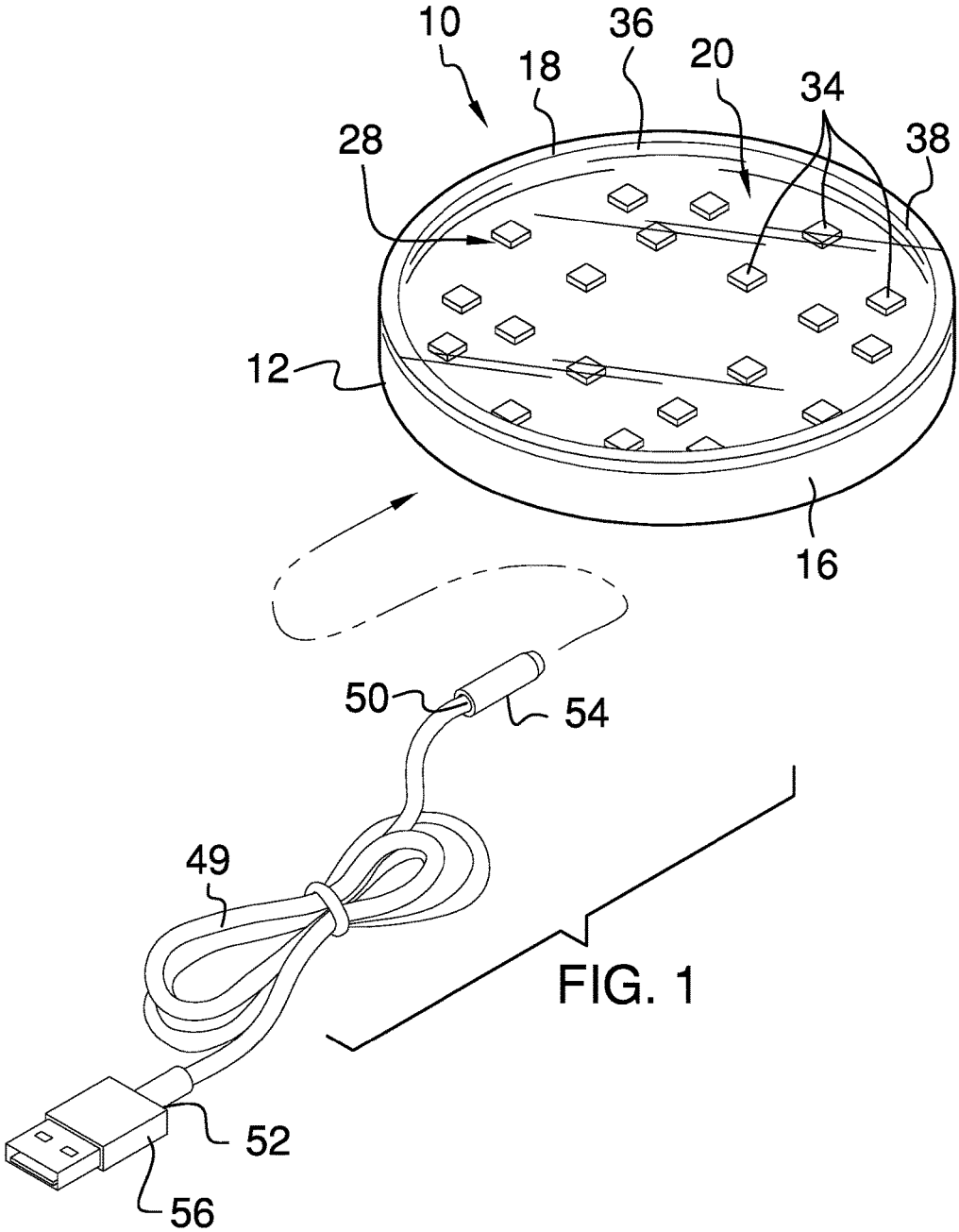
FIG. 1 is a top perspective view of an illuminated ornament assembly according to an embodiment of the disclosure.
Figure 2:
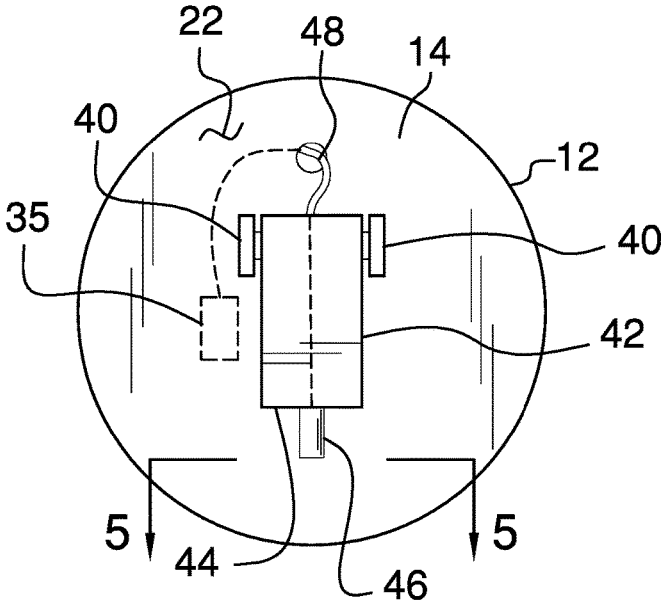
FIG. 2 is a bottom view of an embodiment of the disclosure.
Figure 3:
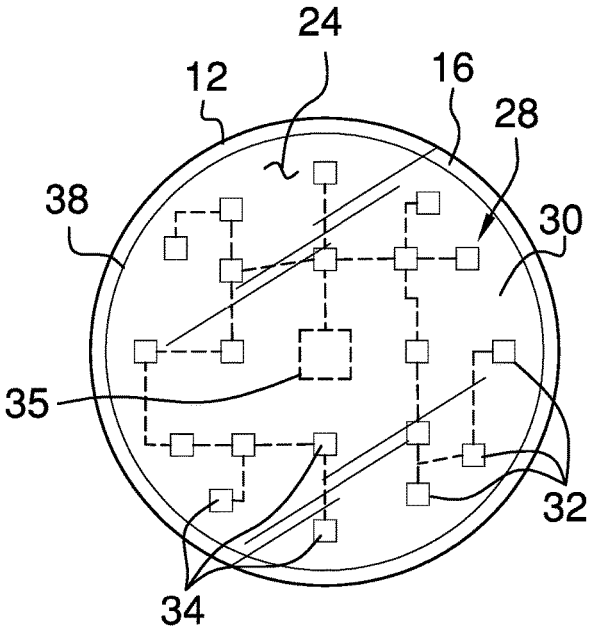
FIG. 3 is a top phantom view of an embodiment of the disclosure.
Figure 4:
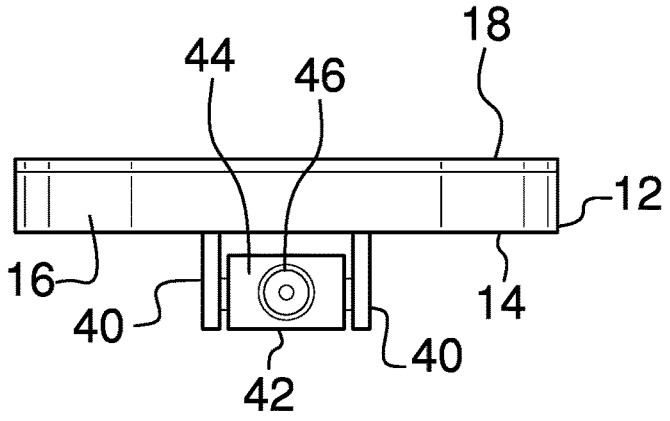
FIG. 4 is a front view of an embodiment of the disclosure.
Figure 5:
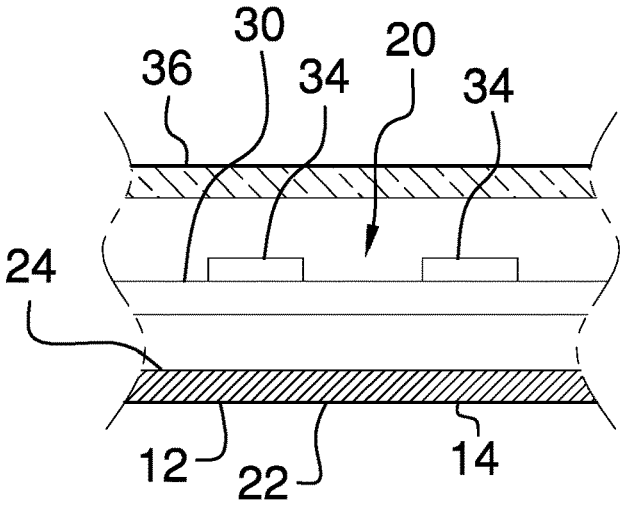
FIG. 5 is a cross sectional view taken along line 5-5 of FIG. 5 of an embodiment of the disclosure.
Figure 6:
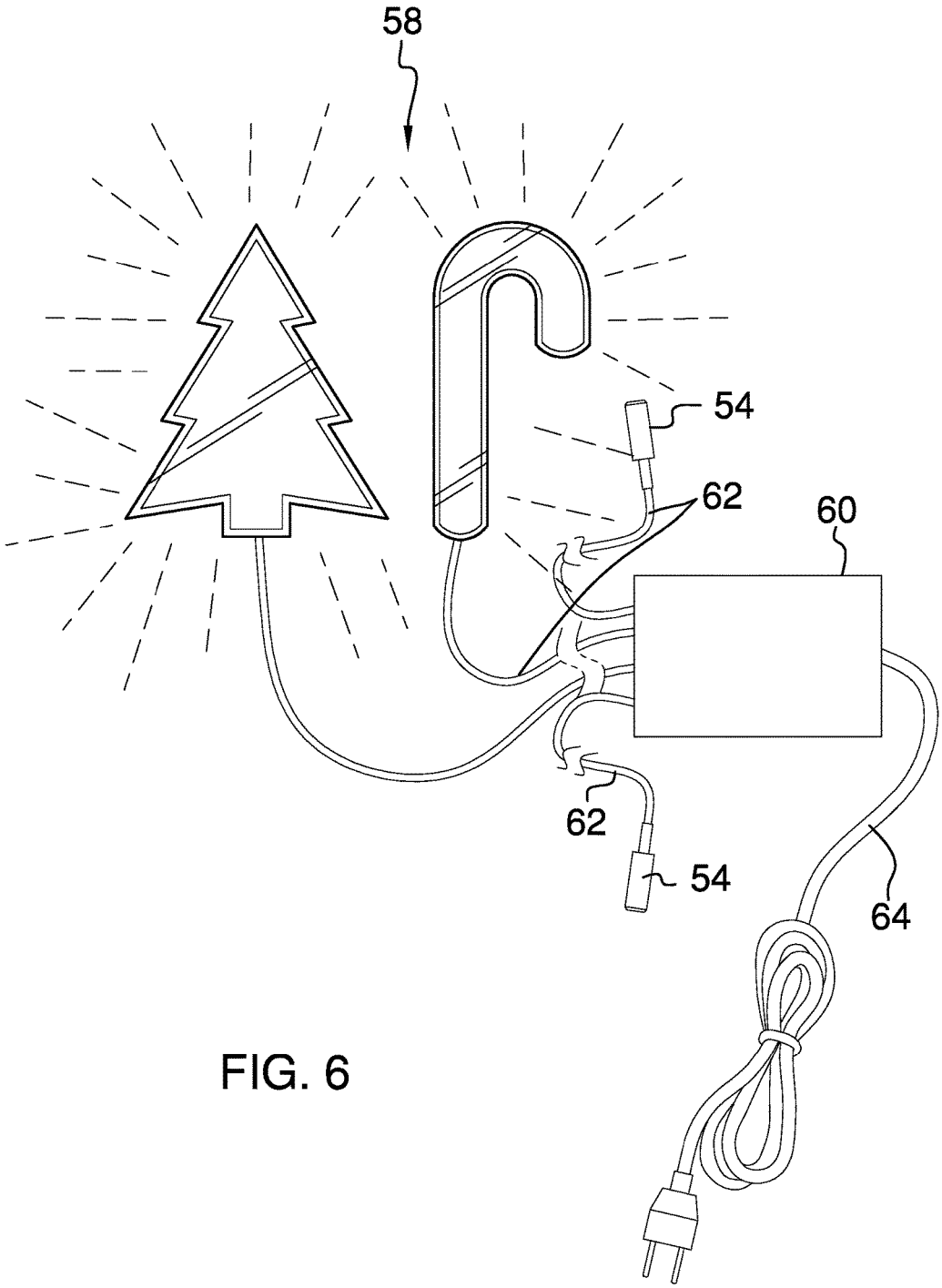
FIG. 6 is a perspective view of an alternative embodiment of the disclosure.
Figure 7:
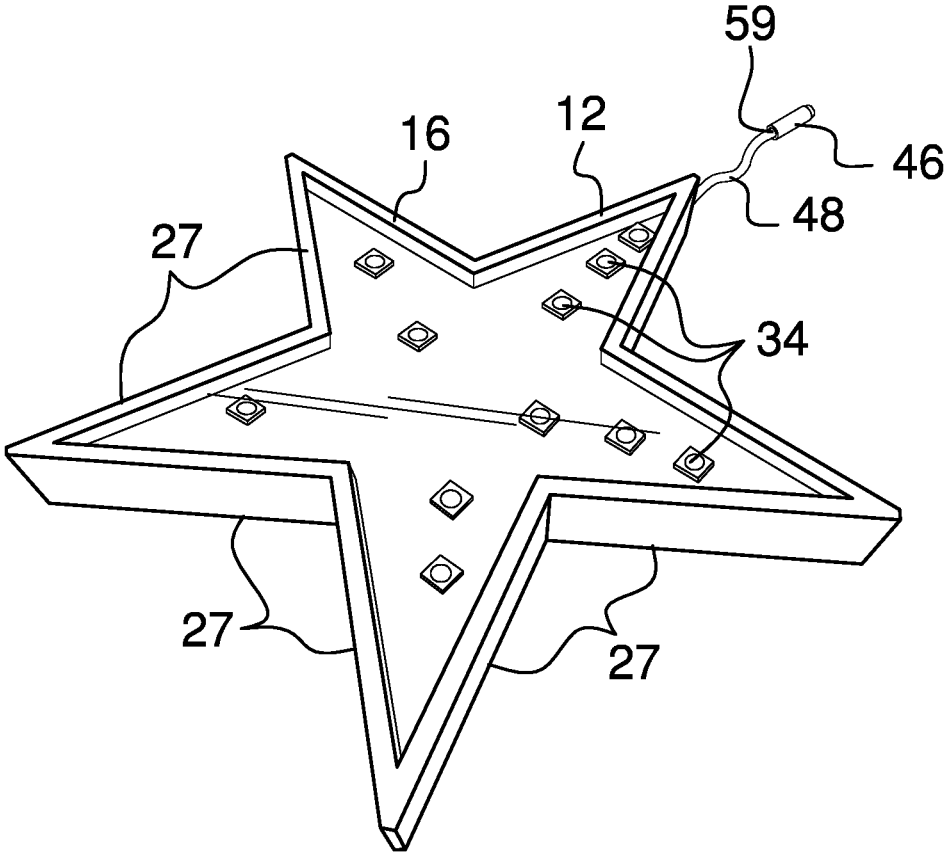
FIG. 7 is a top perspective view of an alternative embodiment of the disclosure.
Figure 8:
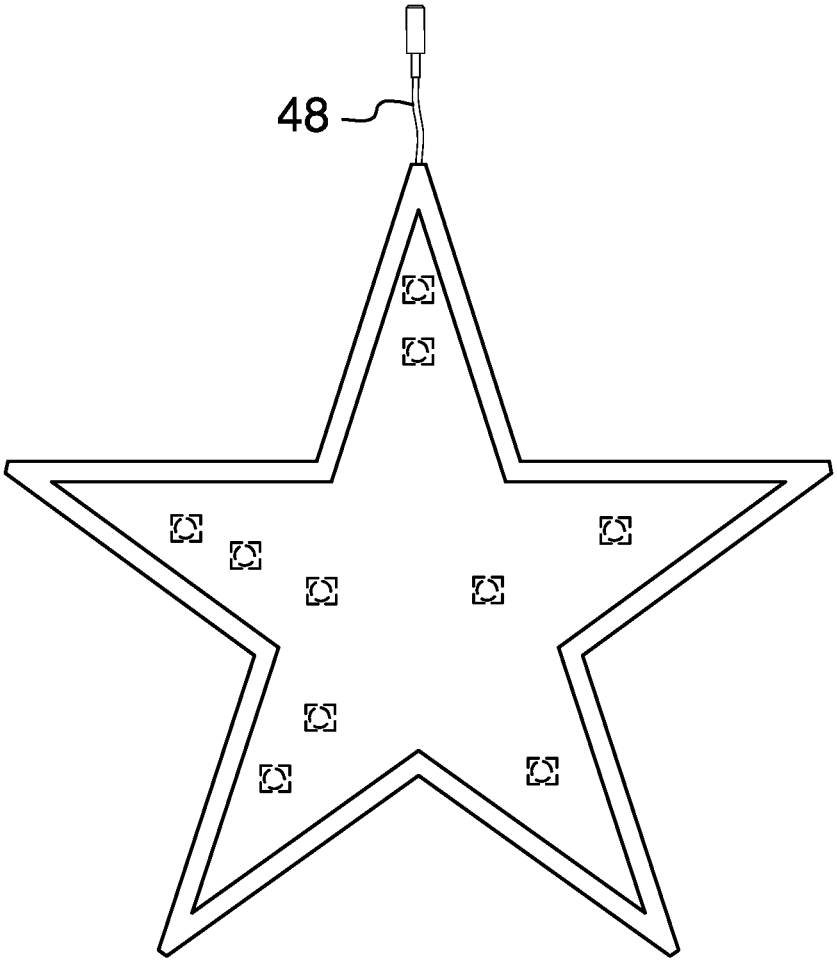
FIG. 8 is a bottom view of an alternative embodiment of the disclosure.
Figure 9:
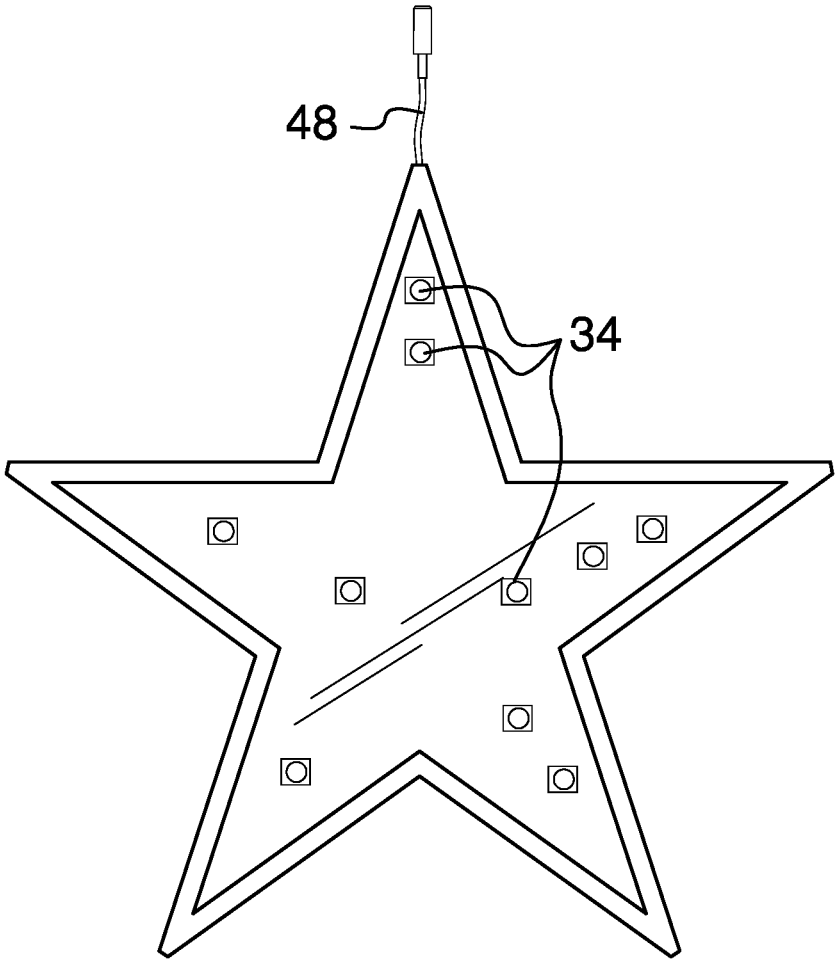
FIG. 9 is a top view of an alternative embodiment of the disclosure.
Figure 10:
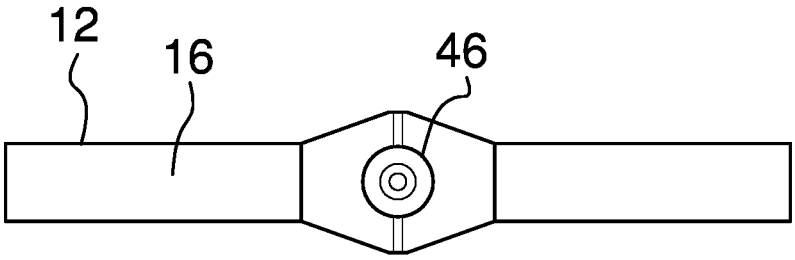
FIG. 10 is a front view of an alternative embodiment of the disclosure.
Figure 11:
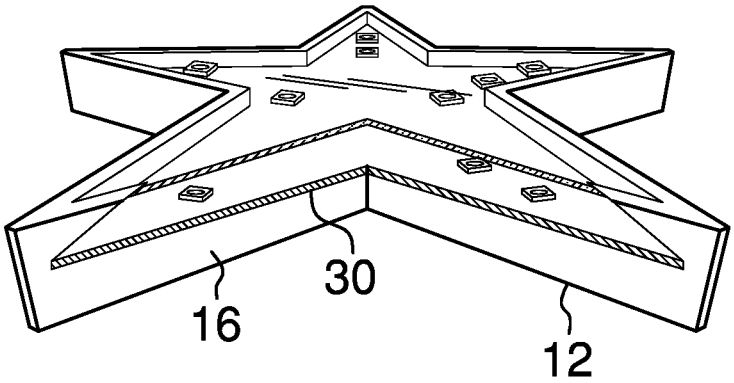
FIG. 11 is a cut-away view of an alternative embodiment of the disclosure.

With reference now to the drawings, and in particular to FIGS. 1 through 12 thereof, a new ornament device embodying the principles and concepts of an embodiment of the disclosure and generally designated by the reference numeral 10 will be described.

As best illustrated in FIGS. 1 through 12, the illuminated ornament assembly 10 generally comprises a housing 12 that may be displayed for ornamental purposes. The housing 12 has a basal wall 14 and a perimeter wall 16 extending away therefrom. The perimeter wall 16 has a distal edge 18 with respect to the basal wall 14 and the distal edge 18 defines an opening 20 into the housing 12. The basal wall 14 has a first surface 22 and a second surface 24 and the perimeter wall 16 is positioned on the second surface 24. Additionally, the basal wall 14 has an opening 26 extending through the first 22 and second 24 surfaces.

Figure 12:
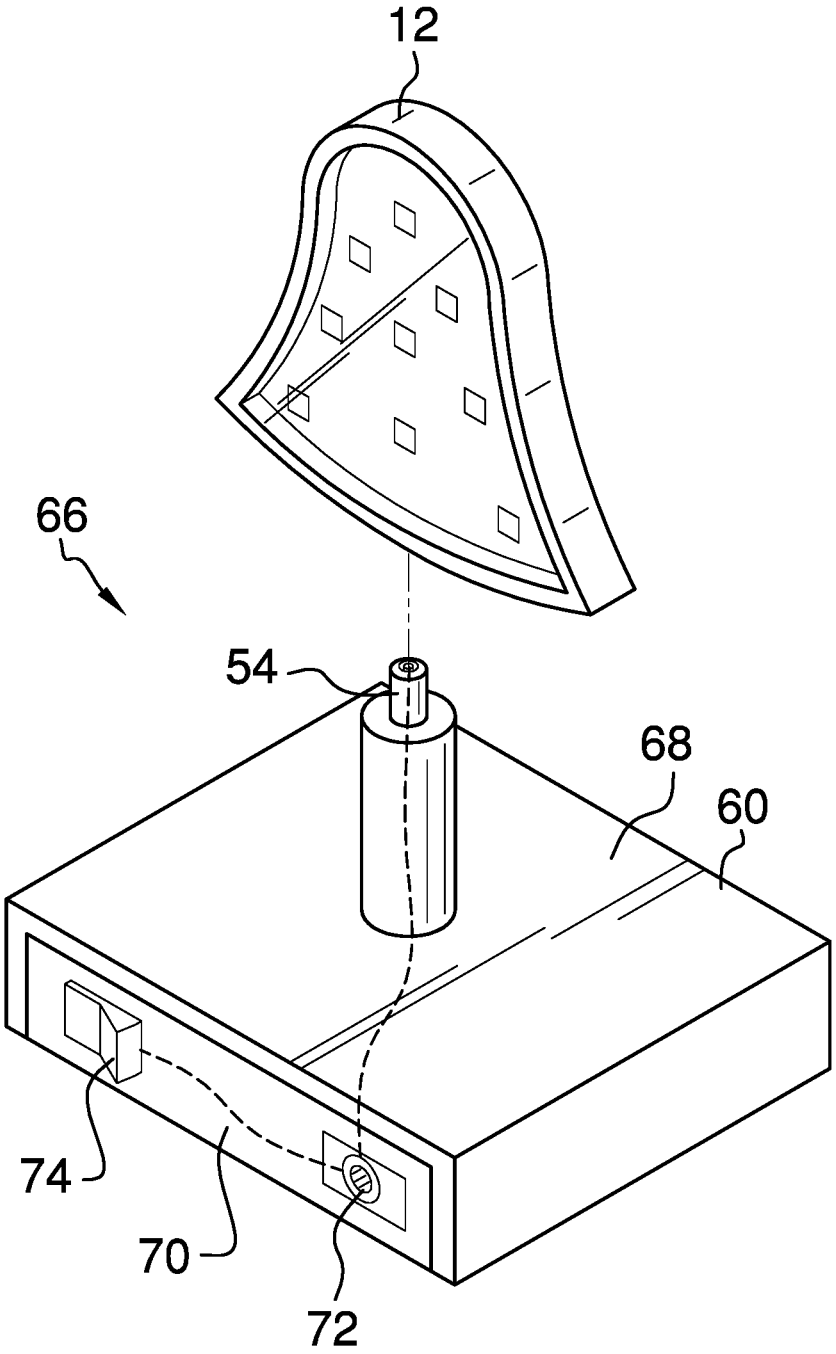
FIG. 12 is a perspective view of an alternative embodiment of the disclosure.

The perimeter wall 16 may be continuous such that the housing 12 has a circular shape. Additionally, the perimeter wall 16 may have a plurality of intersecting sides 27 such that the housing 12 has a star shape, a Christmas tree shape and any other geometric shape that is associated with holiday celebrations. As shown in FIG. 12, the perimeter wall 16 may have a first side and a second side. The first side may be concavely arcuate with respect to the second side. Additionally, the first side may flare outwardly a pair of intersections between the first side and the second side such that said housing 12 has a bell shape.

A light emitting array 28 is positioned in the housing 12 and the light emitting array 28 emits light outwardly therefrom. The light emitting array 28 emits light in a plurality of pre-determined patterns and colors. In this way the light emitter array enhances visual appeal of the ornamental display of the housing 12. The light emitting array 28 comprises a printed circuit board 30 that is positioned in the housing 12. The printed circuit board 30 has a plurality of connection points 32 and each of the connection points 32 is in electrical communication with each other.

A plurality of light emitters 34 is provided and each of the light emitters 34 is coupled to an associated one of the connection points 32. Each of the light emitters 34 emits light outwardly from the housing 12. Each of the light emitters 34 may comprise an LED or the like and each of the light emitters 34 is capable of emitting light in a variety of colors. A processor 35 is coupled to the printed circuit board 30 and the processor 35 is in electrical communication with each of the connection points 32. The processor 35 includes an electronic memory and the electronic memory stores data corresponding to the pre-determined patterns and colors with respect to the light emitters 34.

A lens 36 is coupled to the housing 12 such that the lens 36 covers the light emitting array 28. The lens 36 is comprised of a translucent material to pass the light therethrough. The lens 36 has a perimeter edge 38 and the perimeter edge 38 is coupled to the perimeter wall 16 of the housing 12. Additionally, the lens 36 is aligned with the distal edge 18 of the perimeter wall 16 and the lens 36 completely covers the opening 20 into the housing 12.

A pair of tabs 40 is provided and each of the tabs 40 is coupled to and extends away from the first surface 22 of the basal wall 14. The tabs 40 are spaced apart from each other. A connector 42 is hingedly coupled between the tabs 40 such that the connector 42 is positionable at a selected angle with respect to the housing 12. The connector 42 has a distal end 44 with respect to the tabs 40.

A first plug 46 is coupled to the distal end 44 of the connector 42. A conductor 48 is electrically coupled between the first plug 46 and the processor 35. The first plug 46 may be a male electrical plug or the like. The conductor 48 extends through the opening 20 in the basal wall 14.

A power cord 49 is provided that has a first end 50 and a second end 52. A second plug 54 is electrically coupled to the first end 50 of the power cord 49. The second plug 54 is removably and electrically coupled to the first plug 46. The second plug 54 may be a female electrical plug or the like. A third plug 56 is electrically coupled to the second end 52 of the power cord 49 and the third plug 56 may be electrically coupled to a power source. The third plug 56 may be a usb plug or the like and the power source may be a usb port or the like.

In an alternative embodiment 58 as shown in FIGS. 6 through 11, the tabs 40 and the connector 42 may be absent from the basal wall 14 of the housing 12. The first plug 46 may be electrically coupled to a distal end 59 of the conductor 48 with respect to the housing 12. A power supply 60 may be provided and a plurality of conductors 62 may be electrically coupled to and extend outwardly from the power supply 60. A plurality of the second plugs 54 may be provided and each of the second plugs 54 may be electrically coupled to an associated one of the conductors 62 on the power supply 60. Each of the second plugs 54 may be electrically coupled to the first plug 46 corresponding to a plurality of the housings 12. The power supply 60 may include a power cord 64 and the power cord 64 on the power supply 60 may be electrically coupled to a power source. In this way the power supply 60 may provide electrical power to a plurality of the light emitting arrays 28.

In an alternative embodiment 66 as shown in FIG. 12, the power supply 60 may have a top side 68 and a front side 70. The second plug 54 may be coupled to and extend upwardly from said top side 68 of the power supply 60. A power port 72 may be coupled to the front side 70 of the power supply 60 and the power port 72 may be electrically coupled to the second plug 54. The power port 72 may be electrically coupled to a power source. A switch 74 may be movably coupled to the front side 70 of the power supply 60 and the switch 74 may be electrically coupled to the second plug 54. The housing 12 may be positioned on the second plug 54 such that the second plug 54 is electrically coupled to the light emitting array 28.

In use, the housing 12 is coupled to a support, such as a Christmas tree branch or the like such that the housing 12 is visible as an ornament. The second plug 54 is electrically coupled to the first plug 46 and the third plug 56 is electrically coupled to the power source. Thus, the plurality of light emitters 34 emits light outwardly from the housing 12. In this way the light emitting array 28 enhances celebrating a holiday or the like. Moreover, the light emitting array 28 emits the light in the variety of colors and patterns. Thus, the light emitting array 28 enhances visual appeal of the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated ornament assembly being configured to emit light in a variety of patterns, said assembly comprising:

a housing being configured to be displayed for ornamental purposes, said housing having a basal wall and a perimeter wall extending away therefrom, said perimeter wall having a distal edge with respect to said basal wall, said distal edge defining an opening into said housing, said basal wall having a first surface and a second surface, said perimeter wall being positioned on said second surface, said basal wall having an opening extending through said first and second surfaces;

a pair of tabs, each of said tabs being coupled to and extending away from said first surface of said basal wall, said tabs being spaced apart from each other;

a light emitting array being positioned in said housing wherein said light emitting array is configured to emit light outwardly therefrom, said light emitting array being configured to emit light in a plurality of predetermined patterns and colors; and a connector being hingedly coupled to said housing, said connector being electrically coupled to said light emitting array, said connector being configured to be electrically coupled to a power source, said connector being hingedly coupled between said tabs such that said connector is positionable at a selected angle with respect to said housing, said connector having a distal end with respect to said tabs.

2. The assembly according to claim 1, wherein said light emitting array comprises a printed circuit board being positioned in said housing, said printed circuit board having a plurality of connection points, each of said connection points being in electrical communication with each other.

3. The assembly according to claim 2, further comprising a plurality of light emitters, each of said light emitters being coupled to an associated one of said connection points wherein each of said light emitters is configured to emit light outwardly from said housing.

4. The assembly according to claim 3, further comprising a processor being coupled to said printed circuit board, said processor being in electrical communication with each of said connection points, said processor including an electronic memory, said electronic memory storing data corresponding to the pre-determined patterns and colors.

5. The assembly according to claim 1, further comprising a lens being coupled to said housing such that said lens covers said light emitting array, said lens being comprised of a translucent material wherein said lens is configured to pass the light therethrough, said lens having a perimeter edge, said perimeter edge being coupled to said perimeter wall of said housing having said lens being aligned with said distal edge of said perimeter wall.

6. The assembly according to claim 1, further comprising a first plug being coupled to said distal end of said connector.

7. The assembly according to claim 6, further comprising a conductor being electrically coupled between said first plug and said processor, said conductor extending through said opening in said basal wall.

8. The assembly according to claim 7, further comprising:

a power cord having a first end and a second end;

a second plug being electrically coupled to said first end of said power cord, said second plug being removably and electrically coupled to said first plug; and a third plug being electrically coupled to said second end of said power cord, said third plug being configured to be electrically coupled to a power source.

9. An illuminated ornament assembly being configured to emit light in a variety of patterns, said assembly comprising:

a housing being configured to be displayed for ornamental purposes, said housing having a basal wall and a perimeter wall extending away therefrom, said perimeter wall having a distal edge with respect to said basal wall, said distal edge defining an opening into said housing, said basal wall having a first surface and a second surface, said perimeter wall being positioned on said second surface, said basal wall having an opening extending through said first and second surfaces;

a light emitting array being positioned in said housing wherein said light emitting array is configured to emit light outwardly therefrom, said light emitting array being configured to emit light in a plurality of pre-determined patterns and colors, said light emitting array comprising:

a printed circuit board being positioned in said housing, said printed circuit board having a plurality of connection points, each of said connection points being in electrical communication with each other, a plurality of light emitters, each of said light emitters being coupled to an associated one of said connection points wherein each of said light emitters is configured to emit light outwardly from said housing, and a processor being coupled to said printed circuit board, said processor being in electrical communication with each of said connection points, said processor including an electronic memory, said electronic memory storing data corresponding to the pre-determined patterns and colors;

a lens being coupled to said housing such that said lens covers said light emitting array, said lens being comprised of a translucent material wherein said lens is configured to pass the light therethrough, said lens having a perimeter edge, said perimeter edge being coupled to said perimeter wall of said housing having said lens being aligned with said distal edge of said perimeter wall;

a pair of tabs, each of said tabs being coupled to and extending away from said first surface of said basal wall, said tabs being spaced apart from each other;

a connector being hingedly coupled between said tabs such that said connector is positionable at a selected angle with respect to said housing, said connector having a distal end with respect to said tabs;

a first plug being coupled to said distal end of said connector;

a conductor being electrically coupled between said first plug and said processor, said conductor extending through said opening in said basal wall;

a power cord having a first end and a second end;

a second plug being electrically coupled to said first end of said power cord, said second plug being removably and electrically coupled to said first plug; and a third plug being electrically coupled to said second end of said power cord, said third plug being configured to be electrically coupled to a power source.

* * * * *